US008038043B2

(12) United States Patent
Wang

(10) Patent No.: US 8,038,043 B2
(45) Date of Patent: Oct. 18, 2011

(54) HEAVY DUTY STAPLER

(75) Inventor: Ching-Li Wang, Tali (TW)

(73) Assignee: Apex Mfg. Co., Ltd., Tali, Taichung Hsien (TW)

( * ) Notice: Subject to any disclaimer, the term of this patent is extended or adjusted under 35 U.S.C. 154(b) by 174 days.

(21) Appl. No.: 12/629,094

(22) Filed: Dec. 2, 2009

(65) Prior Publication Data

US 2010/0314431 A1 Dec. 16, 2010

(30) Foreign Application Priority Data

Jun. 11, 2009 (TW) ..... 98119550 A

(51) Int. Cl.
*B25C 5/02* (2006.01)

(52) U.S. Cl. ..... 227/134; 227/120; 227/132

(58) Field of Classification Search ..... 227/120, 227/132, 134, 124, 129
See application file for complete search history.

(56) References Cited

U.S. PATENT DOCUMENTS

| | | | | |
|---|---|---|---|---|
| 5,356,063 | A * | 10/1994 | Perez | 227/132 |
| 5,364,000 | A * | 11/1994 | Fealey | 227/124 |
| 6,776,321 | B2 * | 8/2004 | Jairam et al. | 227/134 |
| 7,404,507 | B2 * | 7/2008 | Marks | 227/132 |
| 7,681,771 | B2 * | 3/2010 | Kandasamy et al. | 227/134 |
| 7,703,652 | B2 * | 4/2010 | Shen | 227/134 |

* cited by examiner

*Primary Examiner* — Scott A. Smith
(74) *Attorney, Agent, or Firm* — Alan Kamrath; Kamrath & Associates PA

(57) ABSTRACT

A heavy duty stapler comprises a base member; a magazine member, which has a first end pivotally connected to the base member and a second end opposite to the first end, including a firing device provided at the second end thereof, with a firing portion formed from an end of the firing device; a lever arm, which has first and second end, including first and second pivotal sections defined at the first end thereof and a pressing section defined at the second end thereof opposite to the first and second pivotal sections, with the first pivotal section pivotally connected to the base member; a linkage member having a first end pivotally connected to the second pivotal section of the lever arm and a second end opposite to the first end thereof; and a driven member including a first pivotal portion pivotally connected to the base member, a second pivotal portion pivotally connected to the second end of the linkage member and a driven portion.

10 Claims, 7 Drawing Sheets

HEAVY DUTY STAPLER

BACKGROUND OF THE INVENTION

Field of the Invention

The present invention relates to a heavy duty stapler, and more particularly to a heavy duty stapler having an effort-saving linkage member.

SUMMARY OF THE INVENTION

Accordingly, the object is achieved by providing a heavy duty stapler. The heavy duty stapler comprises a base member; a magazine member, which has a first end pivotally connected to the base member and a second end opposite to the first end, including a firing device provided at the second end thereof, with a firing portion formed from an end of the firing device; a lever arm, which has first and second end, including first and second pivotal sections defined at the first end thereof and a pressing section defined at the second end thereof opposite to the first and second pivotal sections, with the first pivotal section pivotally connected to the base member; a linkage member having a first end pivotally connected to the second pivotal section of the lever arm and a second end opposite to the first end thereof, with the whole length of the linkage member being able to be perpendicular to a direction of the first end of the lever arm from the first pivotal section to the second pivotal section; and a driven member including a first pivotal portion pivotally connected to the base member, a second pivotal portion pivotally connected to the second end of the linkage member and a driven portion, with a direction of the driven member from the first pivotal portion to the second pivotal portion being able to be perpendicular to the whole length of the linkage member.

Other advantages and features of the present invention will become apparent from the following descriptions referring to the drawings.

BRIEF DESCRIPTION OF THE DRAWINGS

The present invention will be described through detailed illustration of the preferred embodiment referring to the drawings.

DETAILED DESCRIPTION OF THE PREFERRED EMBODIMENT

Figure 1:
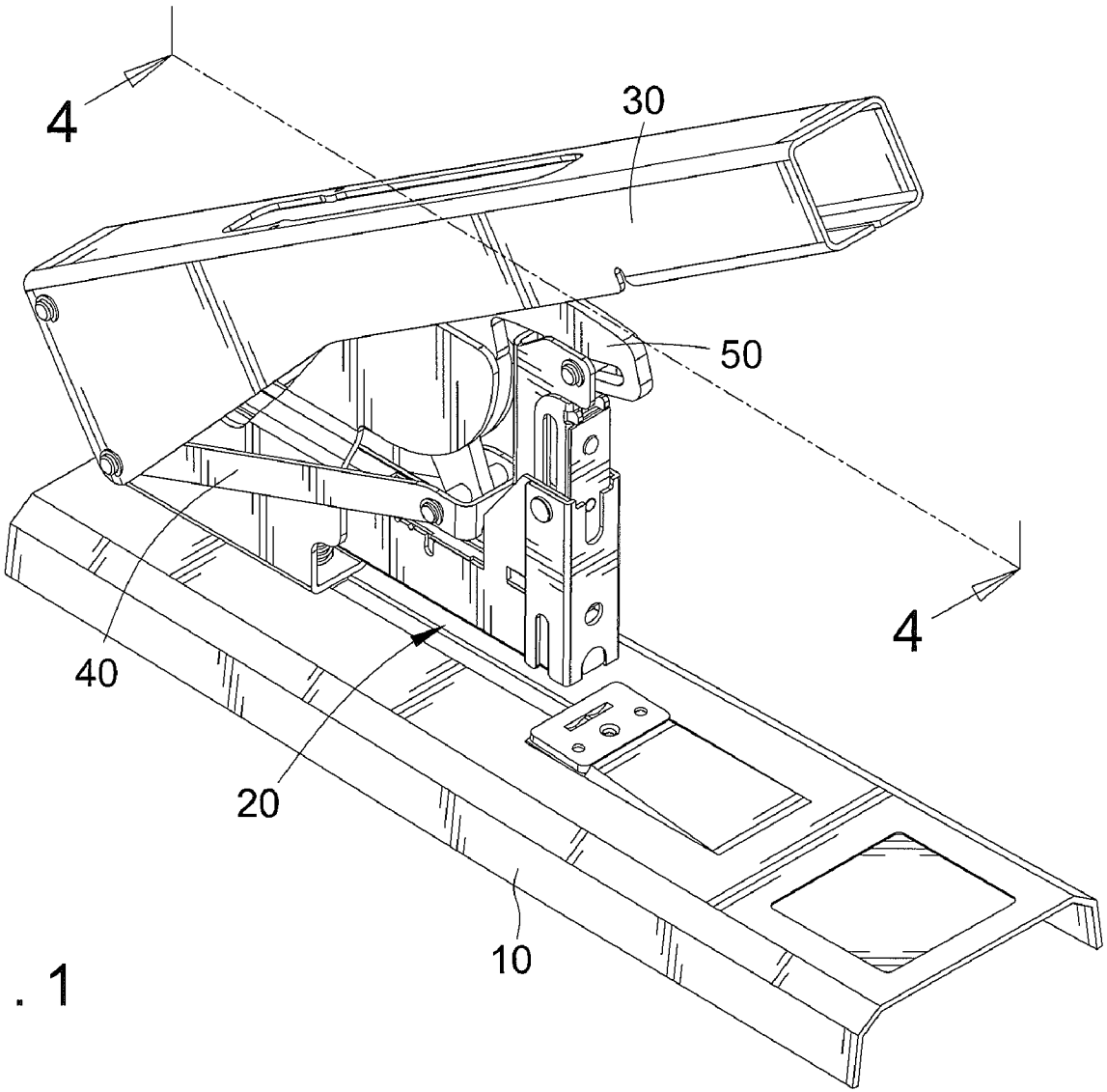
FIG. 1 is a perspective view of a heavy duty stapler according to the preferred embodiment of the present invention.
Figure 2:
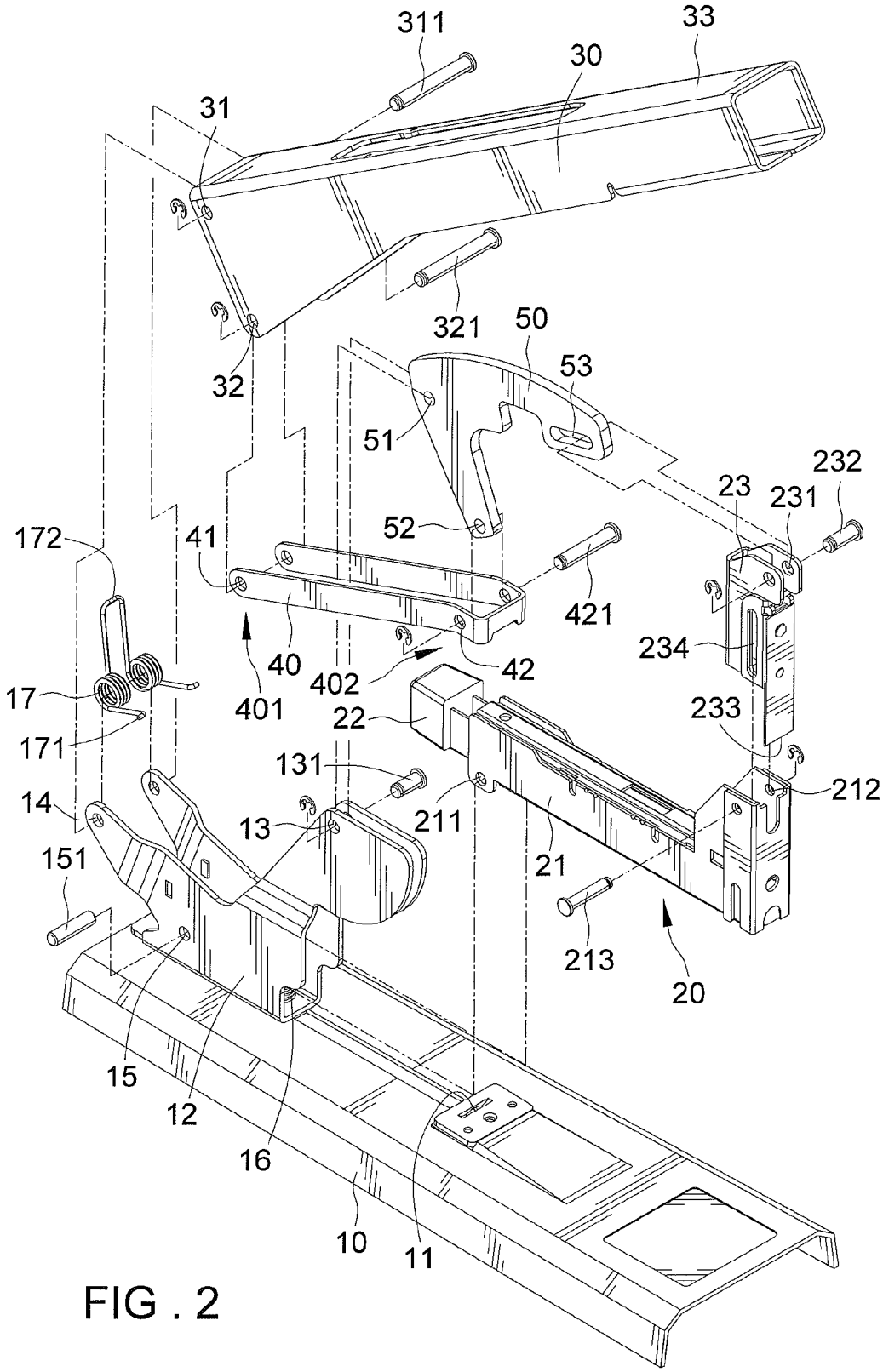
FIG. 2 is an exploded view of the heavy duty stapler as shown in FIG. 1.

With reference to FIGS. 1 and 2, they show that a heavy duty stapler includes a base member 10, a magazine member 20, a lever arm 30, a linkage member 40 and a driven member

50. The base member 10 which has top and bottom surface includes an anvil portion 11 formed on the top surface thereof and a fixture flame 12 installed to an end thereof in a rivet manner. The fixture flame 12 consists of two spaced lateral walls (not numbered) and includes first, second and third pivotal holes 13, 14 and 15 formed through the lateral walls of the fixture flame 12. The first pivotal hole 13 is defined adjacent to the anvil portion 11, the second pivotal hole 14 is defined adjacent to the end of the base member 10 and the third pivotal hole 15 is defined between the first and second pivotal holes 13 and 14. In this case, horizontal positions of the first, second and third pivotal holes 13, 14 and 15 are different to one another with respect to the base member 10 and the horizontal position of the second pivotal hole 14 is provided between that of the first and third pivotal holes 13 and 15. First and second pivotal elements 131 and 151 are respectively provided to insert thought the first and third pivotal holes 13 and 15. A first elastic element 16 is installed to the bottom of the fixture flame 12 adjacent to the third pivotal hole 15 and in this case, the first elastic element 16 is preferably in form of compressed spring. A second elastic element 17 is provided to install to the second pivotal hole 14 and in this case, the second elastic element 17 is preferably in form of torsion spring and has two first legs 171 and a second leg 172. The two first legs 171 of the second elastic element 17 are respectively abutted against the lateral walls of the fixture flame 12 and coupled to the second pivotal hole 14.

The magazine member 20 includes a main body 21, a staple pusher 22 and a firing device 23. The staple pusher 22 is disposed in the main body 21 and adapted for pushing staples which are provided in the main body 21 to slide transversely toward the firing device 23. The main body 21 has first and second ends and includes first and second apertures 211 and 212 respectively formed at the first and second ends thereof. The staple pusher 22 is installed to the first end of the main body 21 and adjacent to the first aperture 211. The third pivotal hole 15 and the first aperture 211 are engaged with each other via the second pivotal element 151. The firing device 23 is slideably installed to the second end of the main body 21 in a longitudinal direction and includes first and second ends. A hole 231 is formed at the first end of the firing device 23 and a shaft 232 provided to insert through the hole 231. A firing portion 233 is formed at the second end of the firing device 23 and a sliding rail 234 is defined between the first and second ends of the firing device 23. A shaft 213 is provided to engaged the second aperture 212 with the sliding rail 234 and the firing device 23 is able to slide longitudinally with respect the shaft 213 via the sliding rail 234.

The lever arm 30 which has first and second ends includes first and second pivotal sections 31 and 32 defined at the distal of the first end thereof and a pressing section 33 defined at the second end thereof opposite to the first and second pivotal sections 31 and 32. First and second pivots 311 and 321 are respectively provided at the first and second pivotal sections 31 and 32. The first pivotal section 31 is engaged with the second pivotal hole 14 of the base member 10 via the first pivot 311. The first pivot 311 is inserted through the second elastic element 17 in the meanwhile. The lever arm 30 further consists of two spaced lateral walls and an intermediate plate sandwiched by the two lateral walls. The second leg 172 of the second elastic element 17 is abutted against the bottom surface of the intermediate plate of the lever arm 30.

The linkage member 40 which has a first end 401 and a second end 402 includes first and second pivotal orifices 41 and 42 respectively provided at the first and second ends 401 and 402 thereof. The first pivotal orifice 41 is joined to the second pivotal section 32 of the lever arm 30 via the second pivot 312. A linkage pivot 421 is inserted through the second end 402 of the linkage member 40 and adapted to pivotally couple the second end 402 of the linkage member 40 to the driven member 50. A direction of the whole length of the linkage member 40 is adjustable to be approximately perpendicular to a direction of the first end of the lever arm 30 from the first pivotal section 31 to the second pivotal section 32.

The driven member 50 is preferably L-shaped and includes first and second pivotal portions 51 and 52 and a driven portion 53. In this case, the driven portion 53 is preferably in form of a slot. The first pivotal portion 51, the second pivotal portion 52 and a center of the driven portion 53 preferably constitute a triangle form. The first pivotal portion 51 is joined to the first pivotal hole 13 of the base member 10 via the first pivotal element 131. The second pivotal portion 52 is pivotally couple to the second pivotal orifice 42 of the linkage 40 via the linkage pivot 421. A direction of the driven member 50 from the first pivotal portion 51 to the second pivotal portion 52 is adjustable to be approximately perpendicular to a direction of the whole length of the linkage member 40. The driven portion 53 corresponds to and is engaged with the hole 231 of the firing device 23 via the shaft 232 of the firing device 23. Hence, while the shaft 232 slides along the driven portion 53, the driven member 50 is driven to slide with respect to the shaft 232.

Figure 3:
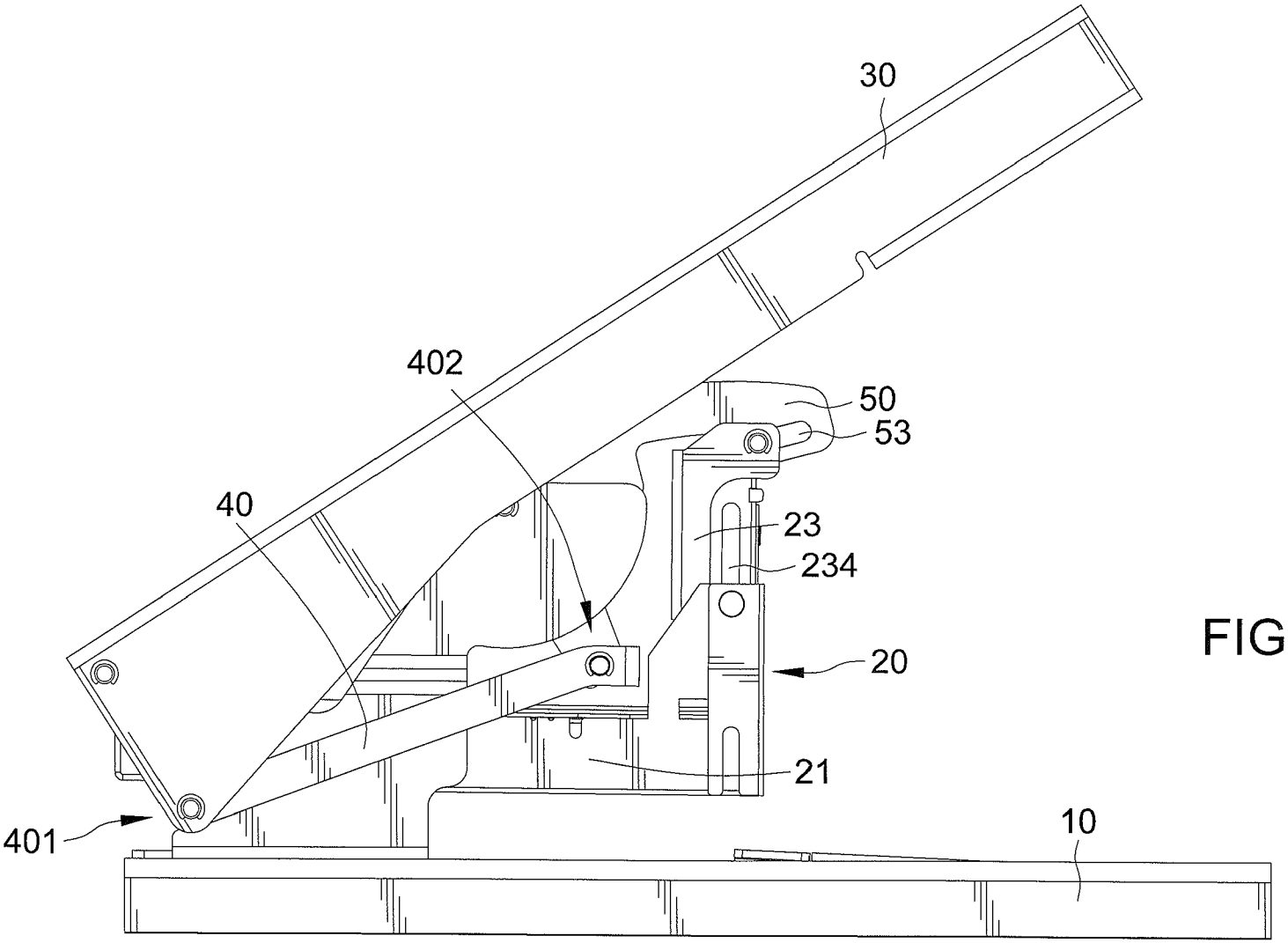
FIG. 3 is a front view of the heavy duty stapler as shown in FIG. 1.
Figure 4:
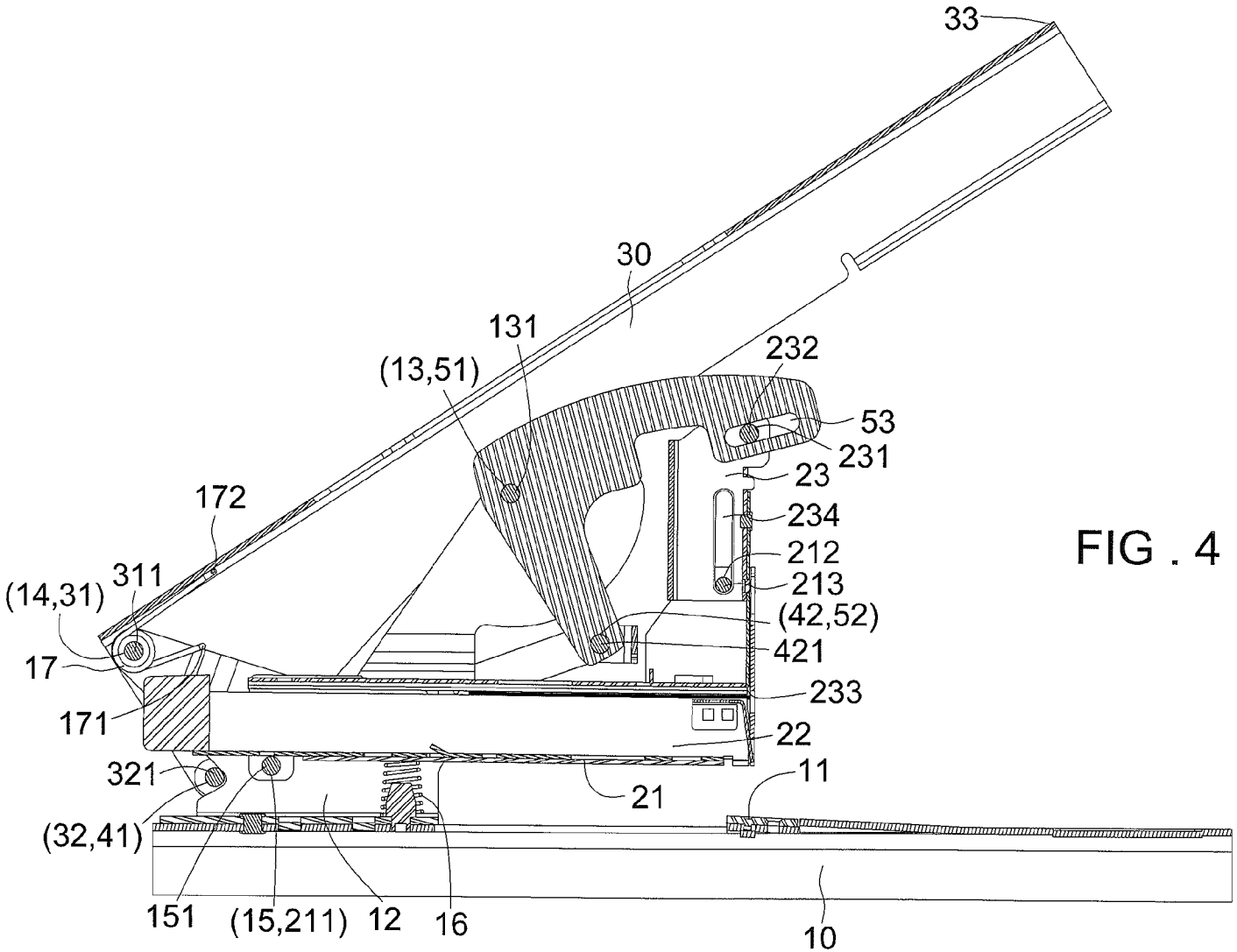
FIG. 4 is a cross-sectional view taken along 4-4 in FIG. 1.

Referring to FIGS. 3 and 4, they show that the heavy duty stapler is in an original position and not be operated yet. The second elastic element 17 is released and pushes the bottom surface of the intermediate plate of the lever arm 30 to raise the pressing section 33 of the lever arm 30. Further, the first elastic element 16 is also released and pushes the magazine member 20 to raise the second end of the magazine member 20 at which the firing device 23 that stores staples is installed. The firing portion 233 of the firing device 23 is away from the anvil portion 111 of the base member 10 while the heavy duty stapler is in the original position.

The third pivotal hole 15 of the base member 10 is pivotally joined to the first aperture 211 of the magazine member 20. The second pivotal section 32 of the lever arm 30 is pivotally joined to the first pivotal orifice 41 of the linkage member 40. The second pivotal orifice 42 of the linkage member 40 is pivotally joined to the second pivotal portion 52 of the driven member 50. The first pivotal portion 51 of the driven member 50 is pivotally joined to the first pivotal hole 13 of the base member 10. The driven portion 53 of the driven member 50 is slideably joined to the hole 231 of the firing device 23. The driven member 50 is able to change position with respect to the firing device 23 and further the firing device 23 is able to move longitudinally with respect to the main body 21 of the magazine member 20.

Figure 5:
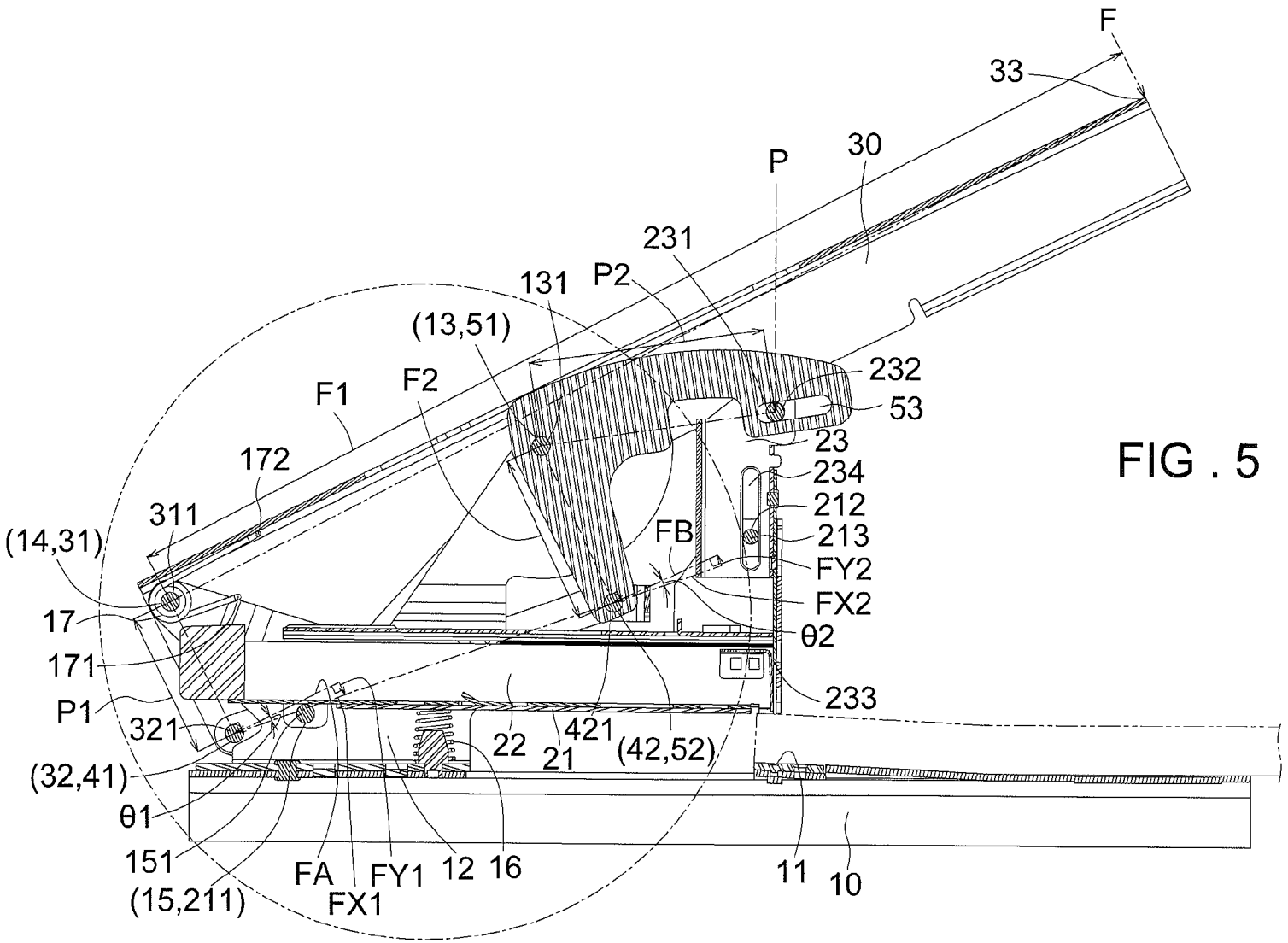
FIG. 5 is a sketch view of the heavy duty stapler as shown in FIG. 1, illustrating that the heavy duty stapler binds papers together.
Figure 6:
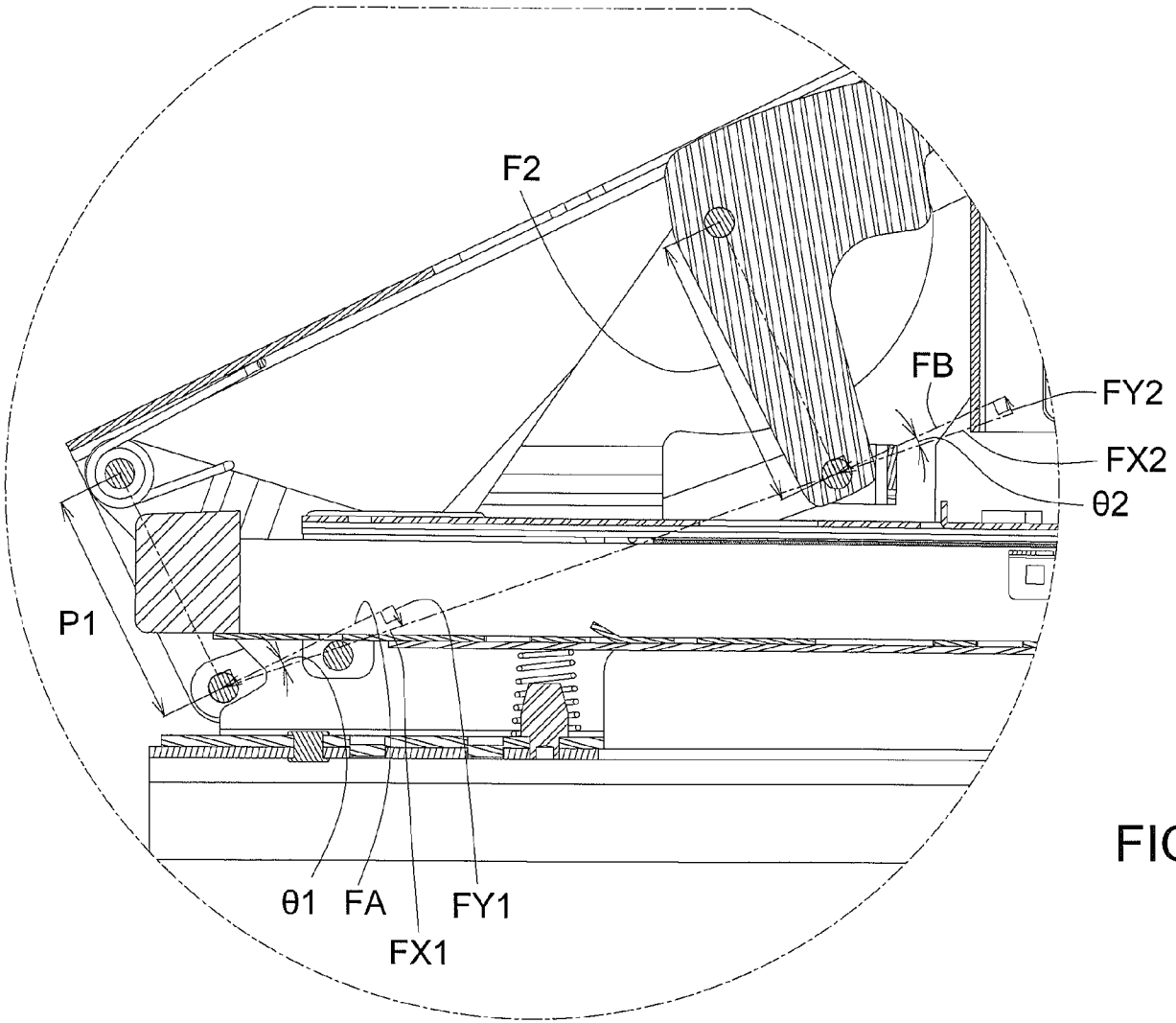
FIG. 6 is an enlarged, partial view of the heavy duty stapler as shown in FIG. 5.

Referring to FIGS. 5 and 6, they shows that while the heavy duty stapler is going to bind papers together, the firing portion 233 hits one of the staples to push legs of the one staple to insert through the papers. Then, the legs are not in contact with the anvil portion 11 yet. A first effort arm F 1 is defined by a distance between the pressing section 33 and the first pivotal section 31 of the lever arm 30 to which the base member 10 is pivotally coupled. A first resistance arm P1 is defined by a distance between the first pivotal section 31 of the lever arm 30 and the second pivotal section 32 of the lever arm 30 to which the linkage member 40 is pivotally coupled. When an application of force, designated by arrow F, is imposed on the pressing section 33 of the lever arm 30, a force FA is generated at the second pivotal section 32 of the lever arm 30.

The lever arm 30 and the driven member 50 are coupled to each other via the linkage member 40. Thus, the force FA forms an angle θ1 with respect to the linkage member 40. The angle θ1 is preferably an acute angle and the force FA is divided into two component forces FX1 and FY1. The component force FX1 is exactly defined through the longitudinal direction of the linkage device 40.

The value of component force FX1 can be calculated by the following formula:

$$FX1=\cos\theta 1*FA$$

Because the angle θ1 is an acute angle and the value of COS θ1 should be less than 1. Hence, the value of the component force FX1 must be smaller than that of the force FA. And the component force FX1 can be transmitted to the linkage pivot 421 of the linkage member 40 to which the driven member 50 is coupled to.

A second effort arm F2 is defined by a distance between the linkage pivot 421 of the linkage member 40 and the first pivotal portion 51 of the driven member 50 to which the base member 10 is coupled to. A second resistance arm P2 is defined by a distance between the first pivotal portion 51 of the driven member 50 and the first pivotal section 31 of the lever arm 30 and the shaft 232 which is slideably disposed in the driven portion 53 of the driven member 50. A force FB whose direction is perpendicular to a direction of the second effort arm F2 is generated at the linkage pivot 421 of the linkage member 40 and forms an angle θ2 with respect to the component force FX1. The angle θ2 is preferably an acute angle and the component force FX1 is divided into the force FB and a force FY2.

The value of the force FB can be calculated by the following formula:

$$FB=\cos\theta 2*FX1$$

Because the angle θ2 is an acute angle and the value of COS θ2 should be less than 1. Hence, the value of the force FB must be smaller than that of the component force FX1 which is consumed during transmission.

Figure 7:
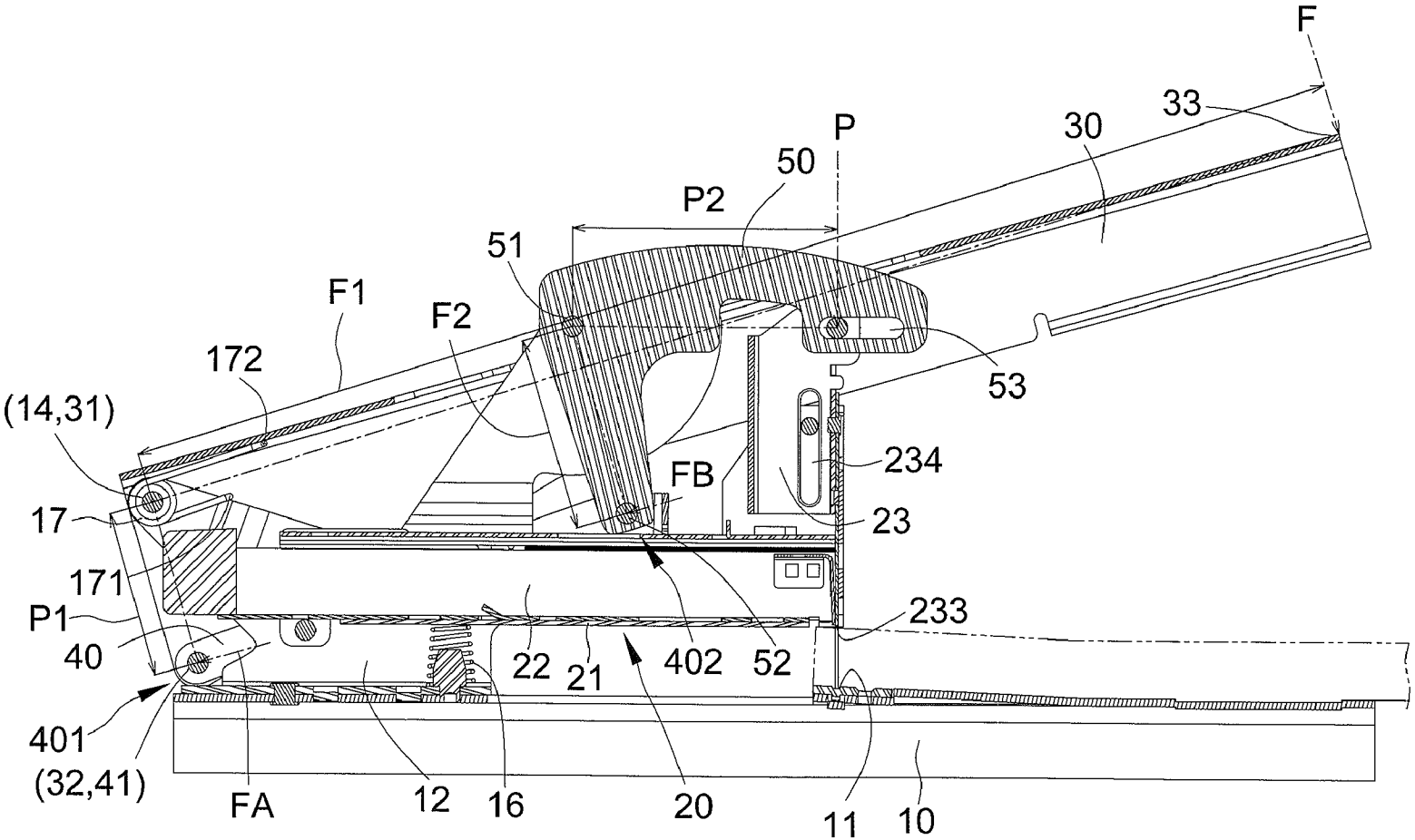
FIG. 7 is another sketch view of the heavy duty stapler similar to FIG. 5, illustrating that while the stapler fires one of staples, the one staple is in contact with the anvil portion of the base member of the stapler.

Referring to FIG. 7, it shows that the force to press the pressing section 33 of the lever arm 30 is sustained. The linkage member 40 is driven by the lever arm 30 and then drives the driven member 50 to pivot. The firing device 23 is controlled to move downward by the driven member 50 and thus the firing portion 233 hits the one of staples. The legs of the one staple are completely inserted through papers and in contact with the anvil portion 11. And further, the legs of the one staple are bent toward the firing portion 233 and press themselves against papers. At this time, the greatest resistance force would be generated and if the application of force F can be completely transmitted to an application of force P which is provided to fire staples and generated at the firing portion 233. Therefore, it can achieve an effort-saving stapler.

While the staple which is hit by the firing portion 233 and the legs of the staple are inserted through papers completely and in contact with the anvil portion 11, a direction of the force FA is perpendicular to that of the first resistance arm P1 and the force FA will not be divided into two component forces. A direction of the force FB is perpendicular to that of the second resistance arm P2 and the force FB will not be divided into two component forces. Thus, the force FA is completely transmitted to the force FB and the force FB is completely transmitted to the force P. In the other words, while the legs of staple are bent by the anvil portion 11, the whole length of the lever arm 40 is perpendicular to the direction of the first end of the lever arm 30 from the first pivotal section 31 to the second pivotal section 32 and also perpendicular to the direction of the first end of the driven member 50 from the first pivotal portion 51 to the second pivotal portion 52. The application of force F can be completely transmitted to the force P to fire staples without any force consumption for effort-saving.

The greatest value of the force F is happened while the legs of staple are bent to press themselves against papers by the anvil portion 11. Because the force FA and FB will not be divided into any component forces, the application of force F can be transmitted to the force P completely without any force consumption.

The ratio of the force P to the force F can be can be calculated by the following formula:

$$P/F=(F1*F2)/(P1*P2)$$

The relationship between the values of F1, F2, P1 and P2 can represent how much effort would be saved during operation of the heavy duty stapler.

While several embodiments of the invention have been shown and described, it will be apparent to those skilled in the art that modifications may be made therein without departing from the scope and spirit of the present invention.

What is claimed is:

1. A heavy duty stapler comprising:

a base member;

a magazine member, which has a first end pivotally connected to the base member and a second end opposite to the first end, including a firing device provided at the second end thereof, with a firing portion formed from an end of the firing device;

a lever arm, which has first and second end, including first and second pivotal sections defined at the first end thereof and a pressing section defined at the second end thereof opposite to the first and second pivotal sections, with the first pivotal section pivotally connected to the base member;

a linkage member having a first end pivotally connected to the second pivotal section of the lever arm and a second end opposite to the first end thereof, with the whole length of the linkage member being able to be perpendicular to a direction of the first end of the lever arm from the first pivotal section to the second pivotal section; and a driven member including a first pivotal portion pivotally connected to the base member, a second pivotal portion pivotally connected to the second end of the linkage member and a driven portion, with a direction of the driven member from the first pivotal portion to the second pivotal portion being able to be perpendicular to the whole length of the linkage member.

2. The stapler as claimed in claim 1 wherein the base member further comprises an anvil portion; wherein when the firing portion of the firing device hits one of staples and legs of the staple are bent and press themselves against papers, the whole length of the linkage member being perpendicular to the direction of the first end of the lever arm from the first pivotal section to the second pivotal section and the direction of the driven member from the first pivotal portion to the second pivotal portion being perpendicular to the whole length of the linkage member.

3. The stapler as claimed in claim 2 wherein the base member includes first, second and third pivotal holes, with the first pivotal hole defined adjacent to the anvil portion, the second pivotal hole defined adjacent to an end of the base member and the third pivotal hole defined between the first and second pivotal holes, with the first pivotal hole connected pivotally to the driven member, and with the third pivotal hole connected pivotally to the magazine member.

4. The stapler as claimed in claim 3, with horizontal positions of the first, second and third pivotal holes being different to one another with respect to the base member, and with the horizontal position of the second pivotal hole provided between that of the first and third pivotal holes.

5. The stapler as claimed in claim 4, further comprising first and second pivotal elements respectively provided to insert thought the first and third pivotal holes, and a first elastic element installed to the bottom of the base member adjacent to the third pivotal hole.

6. The stapler as claimed in claim 5 wherein the first elastic element 16 is in form of a compressed spring.

7. The stapler as claimed in claim 4 further comprising a second elastic element provided to install to the second pivotal hole and having two first legs and a second leg, with the two first legs of the second elastic element respectively abutted against lateral walls of the base member and coupled to the second pivotal hole, with the second leg of the second elastic element abutted against the bottom surface of the lever arm.

8. The stapler as claimed in claim 1 wherein the first and second pivotal portions of the driven member and a center of the driven portion constitute a triangle form.

9. The stapler as claimed in claim 1 wherein the driven portion is in form of a slot; wherein the firing device further includes a hole formed at the first end thereof and a shaft provided to insert through the hole, with the shaft of the firing device joined the driven portion of the driven member to the hole of the firing device.

10. The stapler as claimed in claim 1 wherein the magazine member includes a main body connected pivotally to the base member and including first and second apertures respectively provided at the first and second ends of the magazine member and a shaft; wherein the firing device further includes a sliding rail defined between two ends thereof, with the shaft of the main body coupled the second aperture of the main body and the sliding rail to each other.

* * * * *